US006422245B1

(12) United States Patent
Song

(10) Patent No.: US 6,422,245 B1
(45) Date of Patent: Jul. 23, 2002

(54) ROUGE COMPACT

(75) Inventor: Min Hoon Song, Kyunggi-do (KR)

(73) Assignees: Motodesign Consulting Inc.; Chungin Co., Ltd., both of (KR)

( * ) Notice: Subject to any disclaimer, the term of this patent is extended or adjusted under 35 U.S.C. 154(b) by 0 days.

(21) Appl. No.: 09/917,386

(22) Filed: Jul. 27, 2001

(30) Foreign Application Priority Data

Feb. 24, 2001 (KR) ..... 2001-0004904

(51) Int. Cl.[7] ..... A45D 33/22

(52) U.S. Cl. ..... 132/295; 132/297; 132/301; 132/314; 132/316

(58) Field of Search ..... 132/294, 295, 132/296, 297, 300, 301, 314, 316; 206/581, 776

(56) References Cited

U.S. PATENT DOCUMENTS

| | | | | | |
|---|---|---|---|---|---|
| 3,911,936 | A | * | 10/1975 | Kingsford | 132/79 R |
| 4,555,020 | A | | 11/1985 | Campello et al. | |
| 4,595,028 | A | * | 6/1986 | Yuhara | 132/79 R |
| 4,684,017 | A | | 8/1987 | Watanabe et al. | |
| 4,717,024 | A | * | 1/1988 | Djezovic | 206/581 |
| 4,821,751 | A | * | 4/1989 | Chen | 132/295 |
| 4,826,014 | A | * | 5/1989 | Schefer | 206/581 |
| 5,025,817 | A | * | 6/1991 | Wen | 132/296 |
| 5,107,871 | A | | 4/1992 | Butcher et al. | |
| 5,320,116 | A | | 6/1994 | Ackermann | |
| 5,437,294 | A | * | 8/1995 | Ebbets, III et al. | 132/304 |
| 5,655,553 | A | | 8/1997 | Giese et al. | |
| 6,021,784 | A | * | 2/2000 | Yuhara | 132/293 |
| 6,102,209 | A | * | 8/2000 | D'Andrea | 206/581 |
| 6,129,089 | A | * | 10/2000 | Yuhara | 132/300 |

* cited by examiner

*Primary Examiner*—Eduardo C. Robert
(74) *Attorney, Agent, or Firm*—Schnader Harrison Segal & Lewis LLP

(57) ABSTRACT

Disclosed herein is a rouge compact. The rouge compact includes a body, which has a frame provided with a central opening and a low, inner step, a hook formed on an upper center portion of the frame, and a first hinge boss formed on a lower portion of the frame. A transparent or translucent rouge pallet contains rouge, and has a trough member partitioned by one or more partition walls and a flange member extended from a circumferential edge of the trough member to be brought into contact with the step of the body. An intermediate plate is provided with a second hinge boss on its one side. A lid covers the rouge pallet, and is formed to be arcuate to form a cosmetic appliance containing space, and has a hook recess formed on an upper portion of the lid to be engaged with the hook, a third hinge boss formed on a lower portion of the lid, and a fourth hinge boss formed on one side of the lid. Two hinge pins are fitted into the first hinge boss of the body and the third hinge boss of the lid and into the second hinge boss of the intermediate plate and the fourth hinge boss of the lid, respectively.

5 Claims, 5 Drawing Sheets

ROUGE COMPACT

BACKGROUND OF THE INVENTION

1. Field of the Invention

The present invention relates generally to a rouge compact, and more particularly to a rouge compact, in which a compact body is separately provided with a transparent or translucent rouge pallet for containing rouge and the transparent or translucent rouge pallet is projected through the compact body.

2. Description of the Prior Art

As depicted in FIG. 1, a conventional rough compact 1 is comprised of a body 3 provided with a plurality of rouge compartments 2 to contain rouge, a lid 4 hingedly attached to the body 3 to cover the body 3 and allow the lid 4 to be rotated around a hinge 5, and a latch mechanism for selectively fastening the lid 4 to the body or unfastening the lid 4 from the body. In general, the compact body 3 is provided with a rouge application brush compartment 6, while the lid 4 is provided with a mirror 7.

However, the conventional rouge compact has the following shortcomings.

First, the lid 4 has to be opened to learn the colors and amount of rouge. As a result, the conventional rouge compact causes to a purchaser inconvenience that the consumer has to open the lids 4 of multiple rouge compacts 1 to find a rouge compact 1 containing rouge of desired colors. Additionally, a merchandiser may have his rouge compacts 1 damaged while the purchaser opens the lids 4 of the rouge compacts 1.

Second, after rouge contained in the rouge compact 1 used up, the rough compact 1 becomes useless, thus being discarded. Accordingly, the conventional rouge compact is wasteful.

Third, although a rouge application brush is generally contained in the rouge compact 1, the conventional rouge compact is short of space to contain other cosmetic appliances.

SUMMARY OF THE INVENTION

Accordingly, the present invention has been made keeping in mind the above problems occurring in the prior art, and an object of the present invention is to provide a rouge compact, in which a compact body is separately provided with a transparent or translucent rouge pallet for containing rouge and the transparent or translucent rouge pallet is projected through the compact body, a user thereby easily learning the colors and amount of the rouge without opening its lid, easily replacing rouge pallets when necessary, and forming a sufficient cosmetic appliance containing space inside of the lid.

In order to accomplish the above object, the present invention provides a rouge compact, comprising a body having a frame provided with a central opening and a low, inner step, a hook formed on an upper center portion of the frame, and a first hinge boss formed on a lower portion of the frame; a transparent or translucent rouge pallet for containing rouge, the rouge pallet having a trough member partitioned by one or more partition walls and a flange member extended from a circumferential edge of the trough member to be brought into contact with the step of the body; an intermediate plate provided with a second hinge boss on its one side; a lid for covering the rouge pallet, the lid being formed to be arcuate to form a cosmetic appliance containing space, the lid having a hook recess formed on an upper portion of the lid to be engaged with the hook, a third hinge boss formed on a lower portion of the lid, and a fourth hinge boss formed on one side of the lid; and two hinge pins fitted into the first hinge boss of the body and the third hinge boss of the lid and into the second hinge boss of the intermediate plate and the fourth hinge boss of the lid, respectively.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
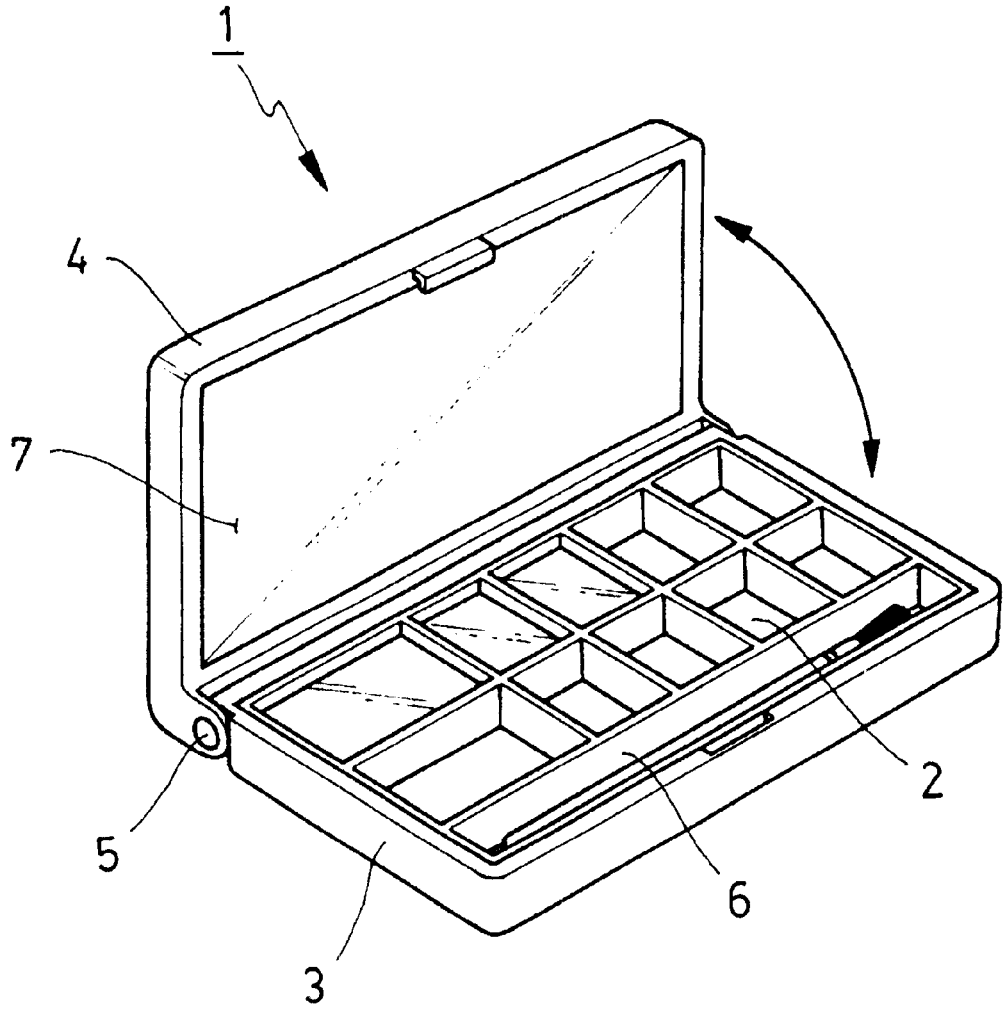
Fig. 1 (PRIOR ART)
FIG. 1 is a perspective view showing a conventional rouge compact.

Reference now should be made to the drawings, in which the same reference numerals are used throughout the different drawings to designate the same or similar components.

Figure 2:
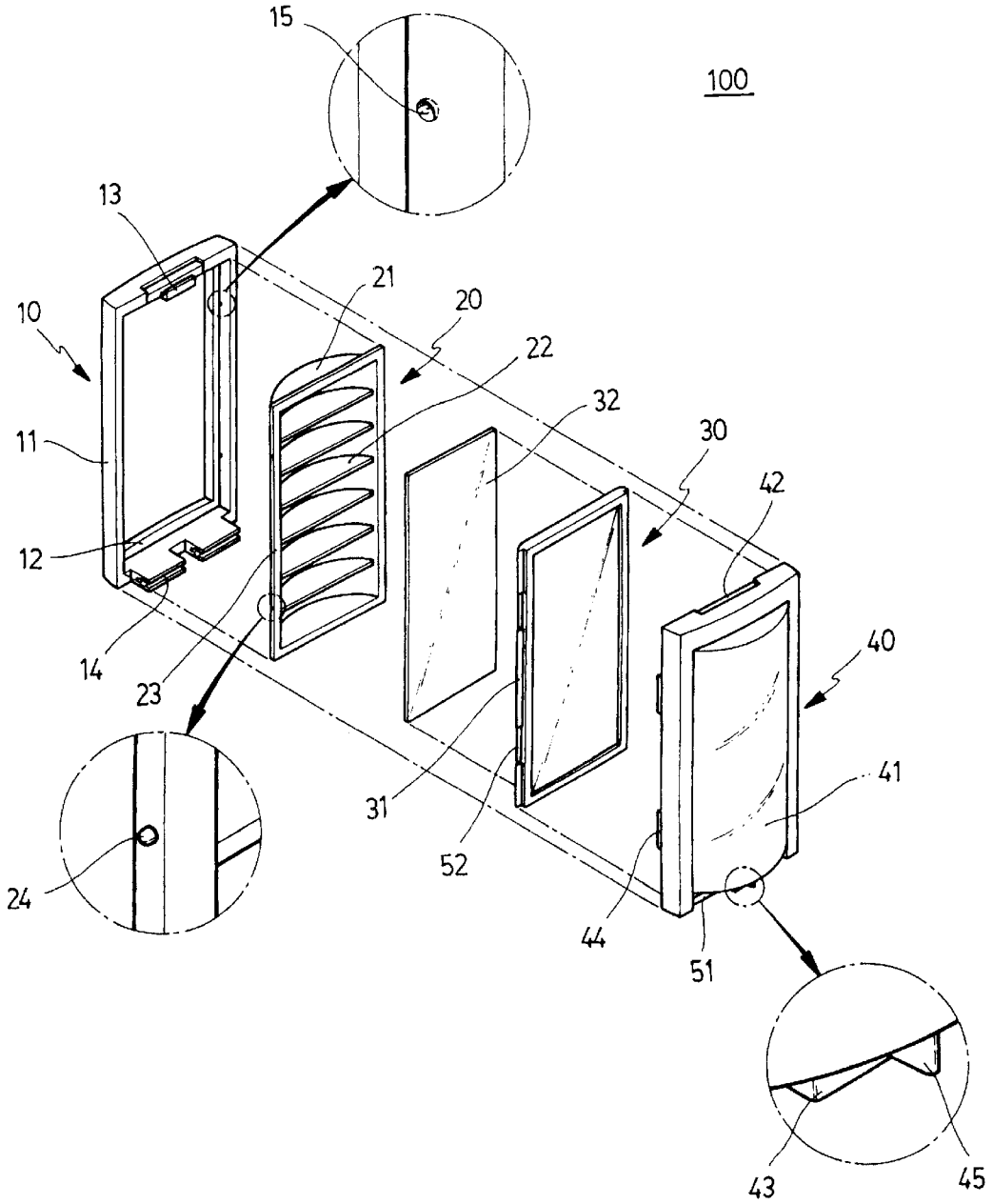
FIG. 2 is a exploded perspective view showing a rouge compact in accordance with the present invention.

Referring to FIG. 2, a rouge compact 100 of the present invention is comprised of a body 10 provided with a central opening, a rouge pallet 20 supported by the body 10 with its central portion projected through the opening of the body 10, an intermediate plate 30, a lid 40 positioned to cover the rouge pallet 20, and two hinge pins 51 and 52 for hingedly attaching the body 10 to the lid 40 and the intermediate plate 30 to the lid 40, respectively.

The compact body 10 includes a frame 11 having a central opening. A relatively low step 12 is formed on the inner portion of the frame 11. A hook 13 is formed on the upper center portion of the frame 11. A hinge boss 14 is formed on the lower portion of the frame 11. The opening of the frame 11 serves to allow the central portion of the rouge pallet 20 to be projected through it, the step 12 serves to allow the rouge pallet 20 to be supported by it, the hook 13 serves to constitute part of the latch mechanism for selectively fastening the lid 40 to the body or unfastening the lid 40 from the body, and the hinge boss 14 serves to constitute part of a hinge mechanism for allowing the lid 40 to be rotatably attached to the compact body 10.

The rouge pallet 20 serves to contain rouge. The rouge pallet 20 is comprised of a trough member 21 partitioned by one or more partition walls 22 and a flange member 23 extended from the circumferential edge of the trough member 21 to the outside. The rouge pallet 20 is supported by the compact body 10, with the flange member 23 of the rough pallet 20 placed on the step 12 of the frame 11 of the compact body 10 and with the trough member 21 of the rouge pallet 20 projected through the opening of the compact body 10. In order to learn the colors and amount of rouge contained in the trough member 21 of the rouge pallet 20 without opening the lid 40 when the trough member 21 is projected through the compact body 10, the rouge pallet 20 should be made of transparent or translucent material.

The rouge pallet 20 forms a semi-cylindrical space. The rough pallet 20 is provided with one or more partition walls 22 in the semi-cylindrical space so as to contain multiple colors or kinds of rouge. However, the rouge pallet 20 is not limited to the above-described shape.

Optionally, the compact body 10 and the rouge pallet 20 have a projection-recess structure for detachably attaching the rouge pallet 20 to the compact body 10. The projection-recess structure consists of a plurality of recesses 15 formed on the compact body over the step 12 and a plurality of projections 24 formed on the side end surfaces of the rouge pallet 20 to be engaged with the recesses 15.

The intermediate plate 30 is provided with a hinge boss 31 on one side of the intermediate plate 30. The intermediate plate 30 is interposed between the rouge pallet 20 and the lid 40. The intermediate plate 30 serves as both a protective cover for protecting rouge contained in the rouge pallet 20 from impurities and a door for selectively opening or closing the containing space 41 formed inside of the lid 40. The hinge boss 31 serves to rotatably attach the intermediate plate 30 to the lid 40. Optionally, a mirror 32 is attached to the surface of the intermediate plate 30.

The lid 40 serves to cover the rouge pallet 20, and is arcuate so as to form a sufficient containing space 41. A hook recess 42 is formed on the upper portion of the lid 40. A hinge boss 43 is formed on the lower portion of the lid 40. Another hinge boss 44 is formed on one side of the lid 40. The hook recess 42 serves to constitute part of a latch mechanism to be selectively engaged with or disengaged from the hook 13 formed on the frame 11 of the compact body 10, the hinge boss 43 serves to constitute part of a hinge mechanism for allowing the lid 40 to be rotatably attached to the compact body 10, and the hinge boss 44 serves to constitute part of a hinge mechanism for allowing the intermediate plate 30 to be rotatably attached to the lid 40.

Figure 3:
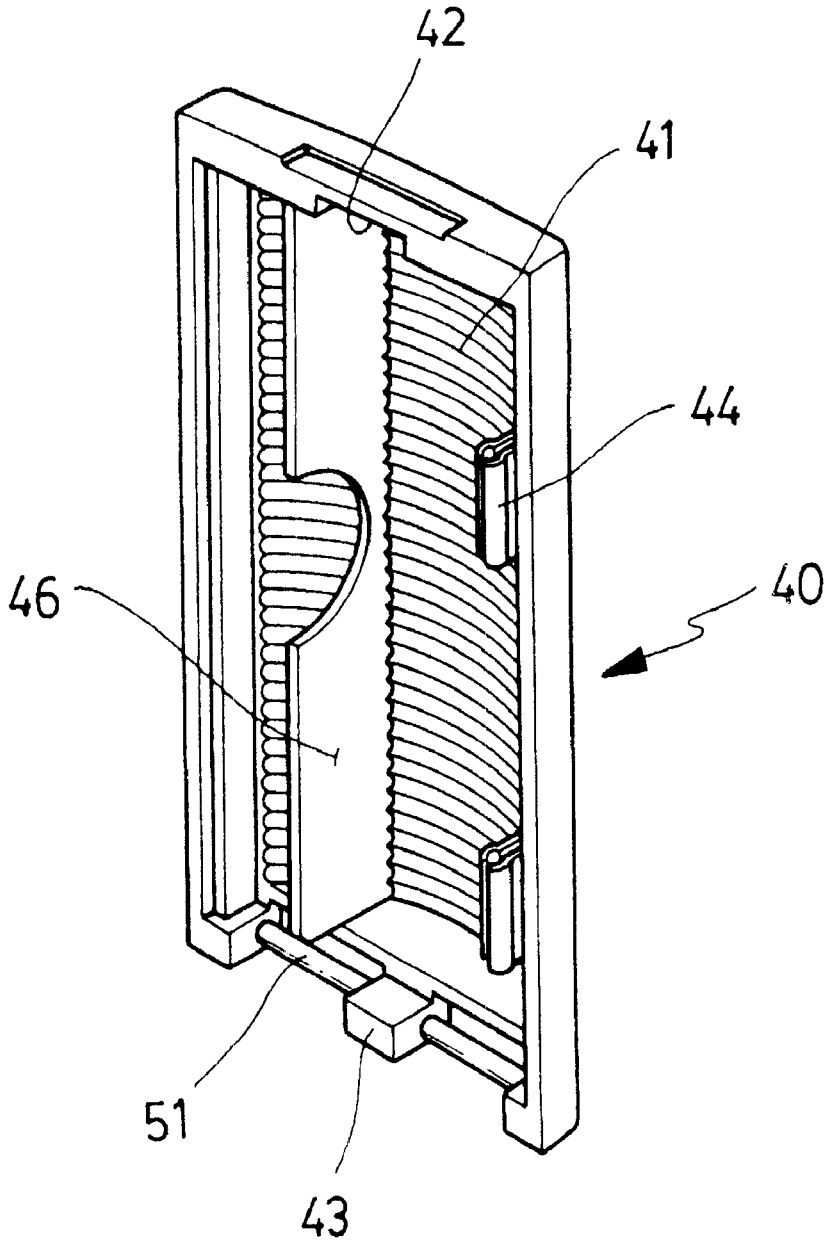
FIG. 3 is a detailed perspective view showing the lid of FIG. 2.

Optionally, a stopper 45 is formed on the outside surface of the hinge boss 43, and serves to prevent the compact body 10 and the lid 40 from being relatively rotated at more than 180°. As shown in FIG. 3, a partition wall 46 is formed across the containing space 41 to effectively contain a variety of cosmetic appliances. The free end of the hinge boss 44 is preferably opened so as to facilitate the replacement of a damaged intermediate plate 30 with a new one when the intermediate plate 30 is damaged in use.

The components 10, 20 and 40, other than the rouge pallet 20 supported by the compact body 10, are rotatably attached to each other by the hinge pins 51 and 52. In detail, one hinge pin 51 is fitted into the hinge boss 14 of the compact body 10 and the hinge boss 43 of the lid 40, while the other hinge pin 52 is fitted into the hinge boss 31 of the intermediate plate 30 and the hinge boss of the lid 40.

Figure 4:
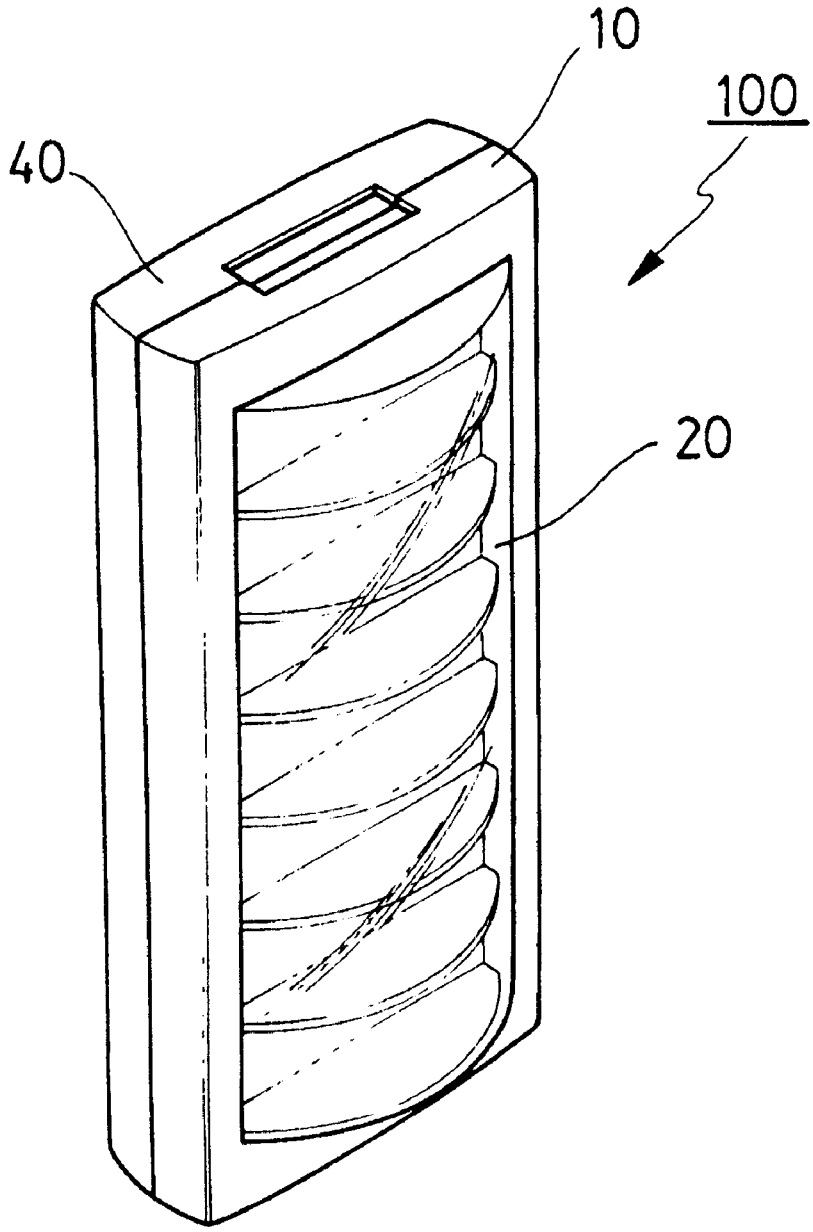
FIG. 4 is a perspective view showing the rouge compact of the present invention in a closed position.

FIG. 4 is a perspective view showing the rouge compact 100 of the present invention in a closed position. As illustrated in the drawing, in the rouge compact 100, when the lid 40 is fastened to the body compact 10 by the latch mechanism, transparent or translucent rouge pallet 20 is interposed between the compact body 10 and the lid 40 to be projected to the outside. Accordingly, even when the lid 40 is not opened, the colors and amount of rouge contained in the rouge pallet 20 can be learned from the outside with the unaided eye.

Figure 5:
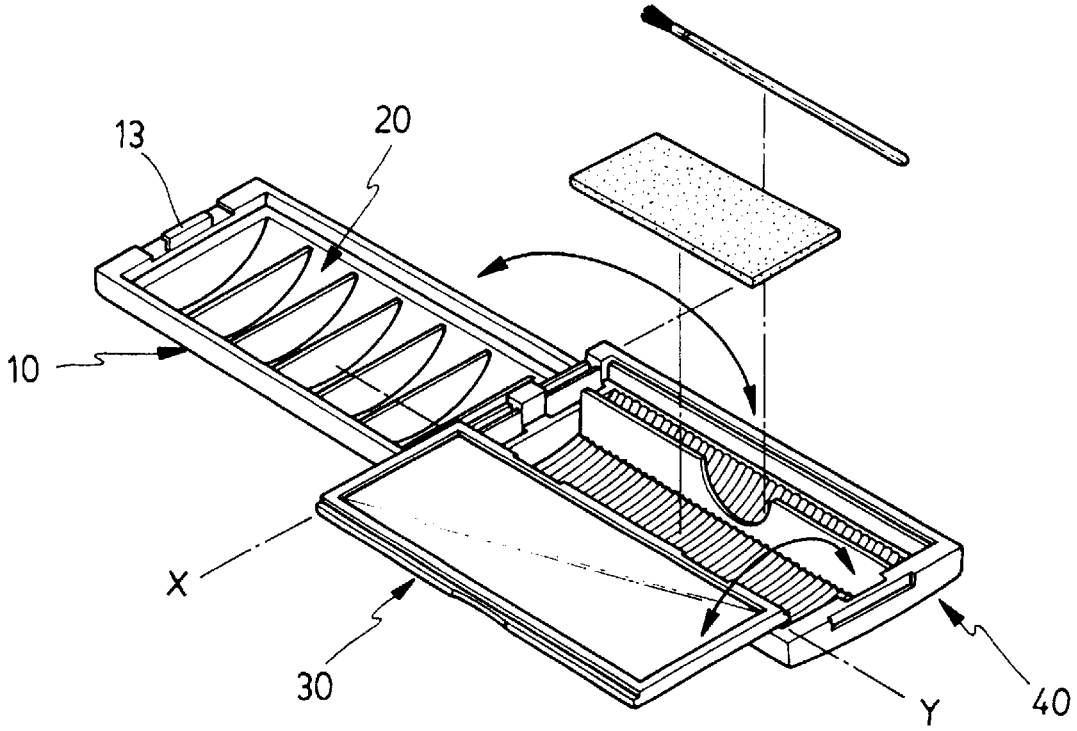
FIG. 5 is a perspective view showing the rouge compact of the present invention in an opened position.

On the contrary, FIG. 5 is a perspective view showing the rouge compact of the present invention in an opened position. In the rouge compact 100, the lid 40 is rotated around an X-axis by the hinge mechanism, and, thereafter, the intermediate plate 30 is rotated around an Y-axis, thereby opening the containing space 41 inside of the rouge pallet 20 and the lid 40.

When the rouge compact 100 is opened in a position shown in FIG. 5, a user can make up her face utilizing the cosmetic appliances contained in the containing space 41, the rouge contained in the rouge pallet 20 and the mirror 32 attached to the intermediate plate 30. When the rouge is used up, the rouge pallet 20 is detached from the compact body 10 by raising up the rouge pallet 20 with the finger and a new rouge pallet 20 or the old rouge pallet 20 filled with rouge is attached to the compact body 10, thereby allowing at least the rouge compact 100 except for the rouge pallet 20 to be used repeatedly.

As described above, the present invention provides a rouge compact, in which the transparent or translucent rouge pallet 20 is mounted on the compact body 10 to be projected to the outside, so the colors and amount of rouge can be easily learned from the outside without opening the rouge compact. Additionally, the rouge compact can be repeatedly used by the replacement of the rouge pallet 20. As a result, convenience is provided in purchase and benefit is provided in use. Additionally, the containing space 41 is provided inside of the lid 40, so the usefulness of the rouge compact is increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A rouge compact, comprising:

a body having a frame provided with a central opening and a low, inner step, a hook formed on an upper center portion of said frame, and a first hinge boss formed on a lower portion of said frame;

a transparent or translucent rouge pallet for containing rouge, said rouge pallet having a trough member partitioned by one or more partition walls and a flange member extended from a circumferential edge of the trough member to be brought into contact with said step of said body;

an intermediate plate provided with a second hinge boss on its one side;

a lid for covering said rouge pallet, said lid being formed to be arcuate to form a cosmetic appliance containing space, said lid having a hook recess formed on an upper portion of said lid to be engaged with said hook, a third hinge boss formed on a lower portion of said lid, and a fourth hinge boss formed on one side of the lid; and two hinge pins fitted into said first hinge boss of said body and said third hinge boss of said lid and into said second hinge boss of said intermediate plate and said fourth hinge boss of said lid, respectively.

2. The rouge compact according to claim 1, wherein said compact body is provided with one or more recesses on said frame at positions over said step and said rouge pallet is provided with one or more projections on side ends of said rouge pallet to be engaged with said recesses.

3. The rouge compact according to claim 1, wherein said trough member is semi-cylindrically shaped, and provided with one or more partition walls in an interior of said trough member.

4. The rouge compact according to claim 1, further comprising a mirror, said mirror being attached to a surface of said intermediate plate.

5. The rouge compact according to claim 1, further comprising a partition wall, said partition being formed across said containing space formed inside of said lid.

* * * * *